US008024873B2

(12) United States Patent
Wright

(10) Patent No.: US 8,024,873 B2
(45) Date of Patent: Sep. 27, 2011

(54) RESILIENT EXCAVATION BUCKET, EXCAVATION APPARATUS, AND METHODS OF USE AND MANUFACTURE THEREOF

(76) Inventor: Danny M. Wright, Hinton, OK (US)

( * ) Notice: Subject to any disclaimer, the term of this patent is extended or adjusted under 35 U.S.C. 154(b) by 0 days.

(21) Appl. No.: 13/043,240

(22) Filed: Mar. 8, 2011

(65) Prior Publication Data

US 2011/0154696 A1 Jun. 30, 2011

Related U.S. Application Data

(63) Continuation of application No. 12/886,273, filed on Sep. 20, 2010, now Pat. No. 7,900,383, which is a continuation of application No. 11/838,449, filed on Aug. 14, 2007, now Pat. No. 7,797,861.

(60) Provisional application No. 60/837,286, filed on Aug. 14, 2006.

(51) Int. Cl.
*E02F 3/32* (2006.01)

(52) U.S. Cl. ..... 37/443; 37/379; 37/444; 37/460

(58) Field of Classification Search ..... 37/443, 37/379, 348, 444, 460, 903, 446; 414/722
See application file for complete search history.

(56) References Cited

U.S. PATENT DOCUMENTS

| | | | | |
|---|---|---|---|---|
| 3,177,950 | A * | 4/1965 | Laikam | 172/5 |
| 3,465,456 | A * | 9/1969 | Meyer | 37/233 |
| 4,905,386 | A * | 3/1990 | Taylor | 37/195 |
| 5,075,985 | A * | 12/1991 | Mensch | 37/407 |
| 5,416,990 | A * | 5/1995 | Otwell | 37/445 |
| 5,526,591 | A * | 6/1996 | Otwell | 37/444 |
| 6,315,056 | B1 * | 11/2001 | Ransom et al. | 172/684.5 |
| 6,428,108 | B1 * | 8/2002 | Chase | 299/36.1 |
| 7,131,221 | B2 * | 11/2006 | Schmeichel | 37/232 |

* cited by examiner

*Primary Examiner* — Thomas Beach
*Assistant Examiner* — Matthew Buck
(74) *Attorney, Agent, or Firm* — Dunlap Codding, P.C.

(57) ABSTRACT

A resilient excavation bucket for use with a piece of machinery having an articulated arm. The excavation bucket comprises a resilient member and a rigid member. The resilient member has a digging edge adapted to deflect in response to pressure from impact with a material at least as rigid as the digging edge and to return to a substantially non-deflected condition upon release of the pressure. The rigid member is cooperatively associated with the resilient member and has a connection member adapted to pivotally engage a portion of the articulated arm of the piece of machinery. At least one of the resilient member and the rigid member at least partially defines a bucket cavity disposed at least partially between the digging edge and the connection member. Additionally, an excavation apparatus comprising a backhoe having an articulated arm and the resilient excavation bucket operatively associated with the articulated arm.

10 Claims, 6 Drawing Sheets

RESILIENT EXCAVATION BUCKET, EXCAVATION APPARATUS, AND METHODS OF USE AND MANUFACTURE THEREOF

CROSS-REFERENCE TO RELATED APPLICATIONS

This application is a continuation of U.S. application Ser. No. 12/886,273, filed Sep. 20, 2010, now U.S. Pat. No. 7,900, 383 which is a continuation of U.S. application Ser. No. 11/838,449, filed Aug. 14, 2007, now U.S. Pat. No. 7,797, 861, which claims the benefit of U.S. Provisional Patent Application No. 60/837,286, filed Aug. 14, 2006, each of which is hereby incorporated herein by reference in its entirety.

BACKGROUND OF THE INVENTION

1. Field of the Invention

The present invention relates generally to equipment and apparatus for excavation, and more particularly, but not by way of limitation, to an improved excavation bucket having a resilient portion adapted to temporarily deflect to prevent damage to buried objects such as pipelines, as well as excavation apparatus utilizing the improved excavation bucket, and methods of use and manufacture thereof.

2. Background of the Invention

Various pieces of equipment are well known in the art for ground excavation. For example, backhoes, trackhoes, tractors, and the like have long been provided with articulated arms and excavation buckets for digging and removing earth, such as for installing and/or unearthing pipelines or other buried items that may be in the vicinity of such buried pipelines. Numerous problems exist with excavation equipment previously known in the art.

One area in which problems are especially prevalent is the excavation of earth in the vicinity of previously-buried pipelines that are active or in use, i.e., have fluids flowing or contained within the pipeline. For example, active pipelines may contain sensitive fluids, such as oil, natural gas, or fresh water. Oil and natural gas are especially sensitive in that a puncture in the pipeline may release flammable and/or combustible fluids that may endanger workers and/or property in the vicinity of the pipeline.

Backhoes especially are often used to excavate earth. Backhoes are generally more efficient than hand-digging because they are provided with an articulated arm and bucket actuated by mechanical means, such as hydraulic cylinders, that permits the bucket to impart much greater force than a typical hand shovel. Additionally, the bucket of backhoe is capable of removing a far greater volume of material than a typical hand shovel. However, known backhoes and related excavation equipment, such as excavation buckets, also have a number of drawbacks. For example, the extraordinary force exerted by the bucket of a backhoe can easily damage existing pipelines. Backhoe buckets are typically made of rigid, durable materials such as hardened steel and iron. Such buckets are also typically formed with a sharpened cutting blade and/or a number of pointed cutting teeth to assist in breaking through packed dirt, clay, and rocks. These known buckets impacting, or pressing against, existing pipelines during digging or excavation can deform, puncture, and otherwise damage existing pipelines.

Previously, most pipelines carrying oil, natural gas, and water were generally formed of rigid, durable materials such as steel or iron. Nevertheless, steel and iron pipelines were still vulnerable to damage by steel buckets. U.S. Pat. No. 4,905,386, issued to Taylor on Mar. 6, 1990, is directed to one attempt to prevent damage to steel pipelines: a cutting edge member for fitting onto an excavation apparatus wherein the cutting edge member is of softer material than iron for digging around pipelines. Taylor teaches that the cutting edge member comprises a flat plate structure formed of soft metals which are softer than steel, for example, aluminum, brass, copper, and Monel®. Taylor further teaches that when the cutting edge contacts a steel pipeline, the cutting edge will deform, e.g., bend, but will not damage the pipeline. The patent describes a test of the apparatus in which the cutting edge struck a steel pipeline and the cutting edge was badly bent and deformed, but did not damage the steel pipeline. The deformed cutting edge then had to be replaced before digging could resume.

The Taylor metal cutting edge of the Taylor patent still has a number of drawbacks. The blade must be replaced each time a steel pipeline is struck. Additionally, the blade is attached to a standard steel bucket and when the blade reaches its limit of deformation, the entire force of the steel bucket will bear down on the pipeline and will eventually still damage the pipeline. The Taylor apparatus is therefore dependent on an operator or other individual visually monitoring the blade to detect when it deforms. More modernly, many pipelines are formed of polymeric material, "poly pipe," that is much less rigid than steel pipe, and is therefore more vulnerable to puncture and damage. Additionally, modern pipelines may be coated with special materials during manufacture or prior to installation, for example cathodic, anodic, and epoxy coatings. Damage to these coatings may render a pipeline vulnerable to corrosion or the like. The blade of the Taylor patent is specifically designed to deform when it contacts a steel pipe, and would likely still easily puncture and/or otherwise damage a modern poly pipe, as well as easily scrape off pipeline coatings.

Several other attempts have been made to prevent damage to buried pipelines. Systems have been proposed to bury a conductive "tracer" wire with a buried pipeline when the pipeline is first installed. When digging or excavation is undertaken near the pipeline, a current can be passed through the tracer wire and a sensor system attached to the bucket to indicate to an operator of the backhoe when the bucket approaches or comes close to the tracer wire, and thus, the pipeline. Such systems require the tracer wire to be placed consistently along the length of the pipeline and requires electronic sensing equipment requiring electrical power and subject to failure. If the tracer wire is installed with any breaks, or is later broken, the system is rendered inoperable. Additionally, pipelines buried before such systems came into use are not provided with the necessary tracer wire and cannot be sensed by such systems. Such systems, when usable, may also be complex and cost-prohibitive.

To this end, a need exists for more versatile and simpler systems and apparatus for preventing damage to buried pipelines while digging and/or excavating in the vicinity of such pipelines. It is to such a need that the present invention is directed.

DETAILED DESCRIPTION OF EXEMPLARY EMBODIMENTS

Figure 1:
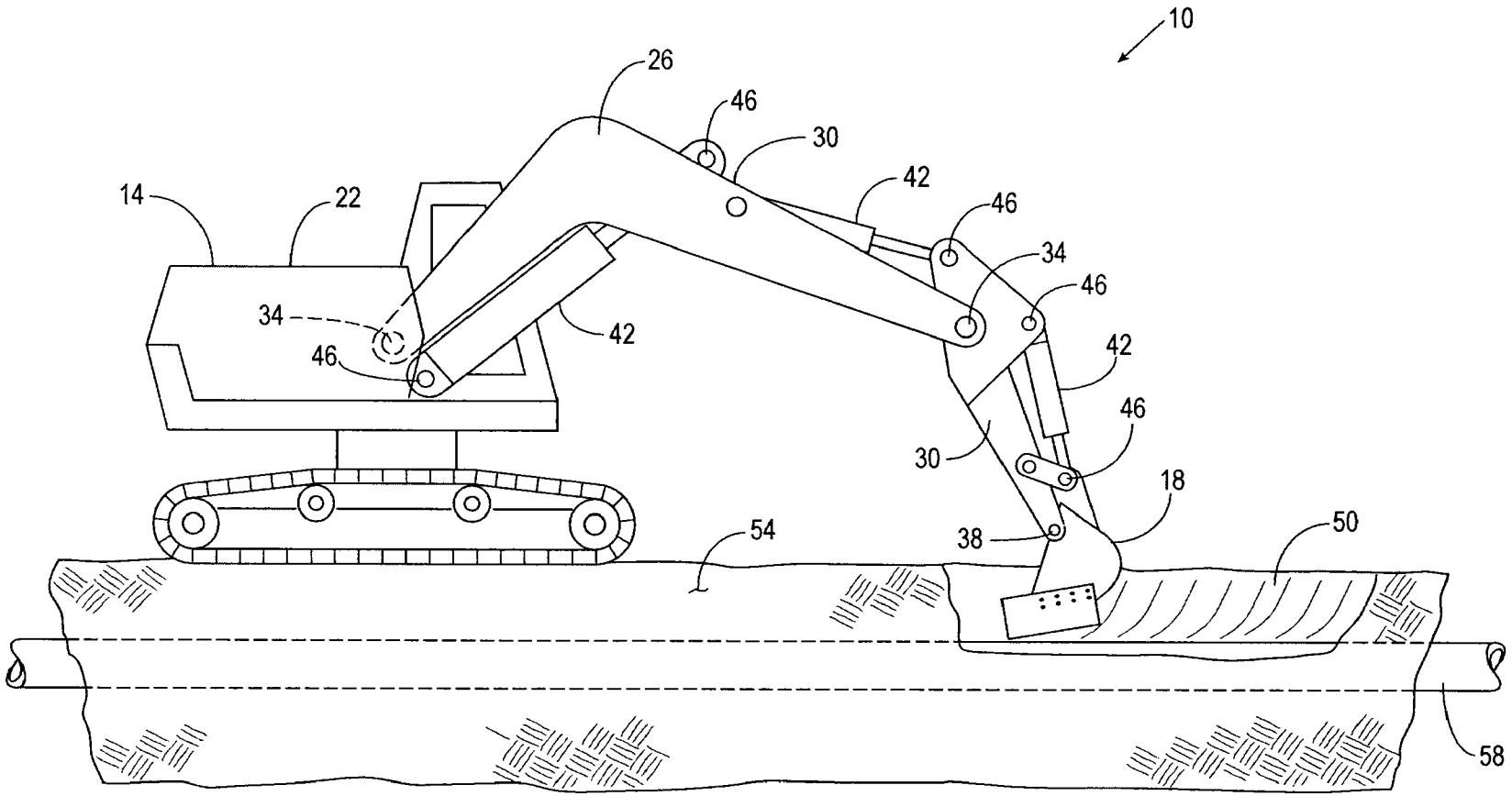
FIG. 1 is a partially cutaway side-view diagram of a backhoe utilizing an excavation bucket having a resilient portion for excavation in the vicinity of a buried pipeline in accordance with the present invention.

Referring now to the drawings, and more particularly to FIG. 1, shown therein is an excavation apparatus 10 comprising a backhoe 14 and a resilient excavation bucket 18 constructed in accordance with the present invention. As will be appreciated by those skilled in the art, the backhoe 14 depicted is of a type that may commonly be referred to as a trackhoe. Broadly, and as is well known in the art, the backhoe 14 is provided with a body portion 22 and an articulated arm 26. The body portion 22 preferably houses the power source (s) (not shown) such as the engine and/or hydraulic pumps. The articulated arm 26 is generally provided with a plurality of elongated, rigid members 30 pivotally connected to one another and to the body 18 by a plurality of pivot joints 34. As shown, the excavation bucket 18 is preferably pivotally connected to the arm 26 at pivot joint 38. In other embodiments, the bucket 18 may be otherwise operatively associated with the articulated arm 26 by any suitable means. The articulated arm 26 is further provided with a plurality of hydraulic cylinders 42 pivotally connected to the body 22, rigid members 30, and/or the bucket at pivot joints 46. The hydraulic cylinders 42 are selectively expanded and compressed by an operator of the backhoe 14 to actuate the articulated arm 26 and the bucket 18. The backhoe 14 is depicted excavating a trench 50 in the earth 54 around an existing buried pipeline 58.

As will be appreciated by those skilled in the art, the backhoe 14 is only one exemplary piece of machinery that may be utilized with the resilient excavation bucket 18 of the present invention. The resilient excavation bucket 18 of the present invention may be utilized with nearly any piece of machinery having an articulated, or otherwise controllable, arm 26. For example, the backhoe 14 may be substituted with a tractor, bobcat, a towed or stationary piece of digging machinery, or nearly any other type of machinery, having an arm capable of digging with the resilient excavation bucket 18, various embodiments of which will be described in more detail below with reference to FIGS. 2-6A. Backhoes and other pieces of machinery that may be utilized for excavation are well known in the art and no further description thereof is deemed necessary for one skilled in the art to implement the various embodiments of the present invention.

Figure 2:
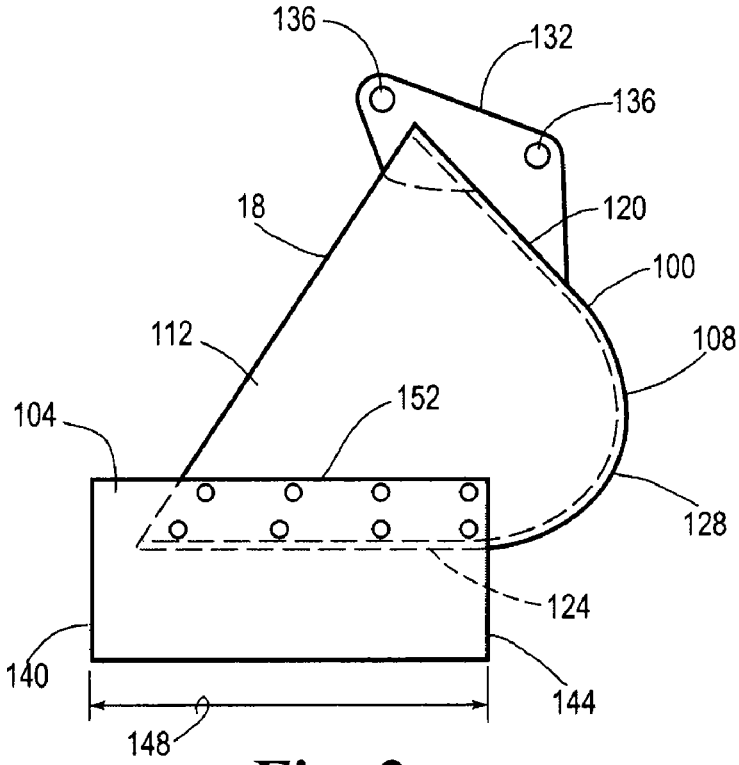
FIG. 2 is a side view of an excavation bucket constructed in accordance with the present invention.
Figure 2A:
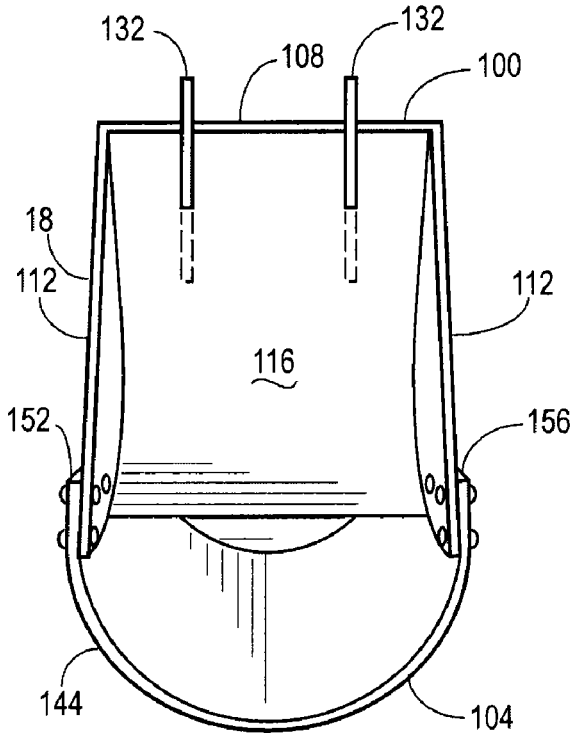
FIG. 2A is a front view of the excavation bucket of FIG. 2.

Referring now to FIGS. 2 and 2A, side and front views, respectively, are shown of one embodiment of an excavation bucket 18 constructed in accordance with the present invention. In the embodiment shown, the bucket 18 is provided with a rigid member 100 and a resilient member 104. The rigid member 100 is preferably formed from a rigid and durable material such as hardened or tempered steel, or any similarly durable material. The resilient member 104 is preferably formed of a polymeric material that is strong and durable, yet flexible enough to deflect in response to the application of pressure, force, or the like, such as is caused by impacting or pressing against a buried pipeline, and resilient enough to return to a substantially non-deformed condition upon release of the pressure or force. The polymeric material of the resilient member 104 must also be rigid enough to dig through earth around a pipeline, but need not, and should not, be as rigid as a standard steel bucket, and need not be as rigid as the rigid member 100. Although polymeric materials are currently preferred for construction of the resilient member 100, any material having the desirable characteristics and properties described above may be used.

As shown, the rigid member 100 is preferably formed with a shape similar to the shape of a standard steel bucket. More specifically, the rigid member 100 is preferably formed with a curved body wall 108 and a pair of lateral sidewalls 112 spaced apart from one another and cooperating with the body wall 108 to define a bucket cavity 116. In one preferred embodiment, the sidewalls 112 are formed with a flattened shape having an upper linear edge portion 120 and a lower linear edge portion 124 and a curved edge portion 128 preferably smoothly meeting, and/or tangent to, the upper and lower linear edge portions 120 and 124. The body wall 108 is also substantially flat in shape and is contoured to join the sidewalls 112 along the upper linear edge portion 120 and the curved edge 128, such that the space between the lower linear edge portions 124 is left substantially open between the sidewalls 112. In other embodiments, the body wall 108 may also join the sidewalls 112 along a portion of the lower linear edge portion 124 as well. The body wall 108 and the sidewalls 112 are preferably of unitary construction or joined by a continuous weld. However, in other embodiments, the body wall 108 and sidewall 112 may be joined by any other suitable means. In one embodiment, the rigid member 100 may be formed from a standard steel backhoe bucket by removing at least a portion of the body wall 108 between the lower linear edge portions 124.

Additionally, the rigid member 100 is provided with one or more connection members 132. In the preferred embodiment, the bucket 18 is provided with a pair of connection members 132 spaced apart laterally. The connection members 132 are preferably planar members joined with the bucket 18, such as by welding or any other suitable means, or integrally formed with the bucket 18 to provide a connection point whereby the bucket 18 can be connected or otherwise operatively associated with the articulated arm of a backhoe 14 (FIG. 1) or other piece of machinery. As shown, each connection member 132 is preferably provided with two apertures 136 spaced apart from one other. In use, one of the two apertures is preferably pivotally connected to one of a rigid member 30 or hydraulic cylinder 42 of the articulated arm 26 (FIG. 1) and the other of the two apertures 136 is preferably pivotally connected to the other of a rigid member 30 or hydraulic cylinder 42 of the articulated arm 26 (FIG. 1) so as to permit the bucket 18 to be selectively actuated to loosen and remove dirt, clay, and/or rocks from the earth.

The resilient member 104 is preferably formed with an elongated shape having a front edge 140, a rear edge 144, and a length 148 therebetween. As best shown in FIG. 2A, the resilient member 104 is preferably also formed with first and second lateral edges 152 and 156, respectively, and a preferably arcuate cross-section. As shown, the resilient member 104 is securely attached to the sidewalls 112 of the rigid portion 100, such as, for example, by bolts, screws, rivets, adhesives, interlocking tabs and/or slots, or any other suitable means. In one embodiment, the resilient member 104 may be formed from a length of poly pipe by removing a longitudinal portion of the sidewall from the poly pipe and attaching the poly pipe to the sidewalls 112 of the rigid member 100, as shown. As will be appreciated by those skilled in the art, in use, the front edge 144 operates as a digging and/or cutting edge 144 that cuts into the earth to loosen dirt, clay, and/or rocks so that such material may be scooped into the bucket cavity 116 to be removed from the ground.

The arcuate shape of the resilient member 104 is especially advantageous for use with the various embodiments of the bucket 18. Specifically, as the bucket 18 is forced downward into the earth, the arcuate shape of the resilient member 104 provides an open shape that permits dirt and the like to be scooped into the bucket cavity 116. As dirt and the like is scooped into the bucket cavity 116, the dirt provides an outward force on the arcuate-shaped resilient member 104, further assisting in maintaining the shape of the resilient member 104 as it digs through the earth, even though the resilient member 104 is less rigid than a typical steel bucket. However, in addition to supporting the functional rigidity of the resilient member 104, the arcuate shape also helps ensure that the resilient member 104 is capable of deflecting when a pressure or force is exerted on the resilient member 104, such as from impacting, or pressing against, an object that is effectively more rigid that the resilient member 104, such as a buried pipeline. Specifically, the arcuate shape of the resilient member 104 permits the resilient member to deflect laterally, vertically, and in combinations thereof so as to prevent the bucket 18 from puncturing or otherwise damaging a buried pipeline. Additionally, the connection of the resilient member 104 to the rigid member 100 only at and/or near the lateral edges 152 and 156 while leaving the rear end 144 of the resilient member unattached to the rigid member 100 further ensures that the resilient member 104 is capable of deflecting when a pressure or force is exerted upon the resilient member 104.

Figure 3:
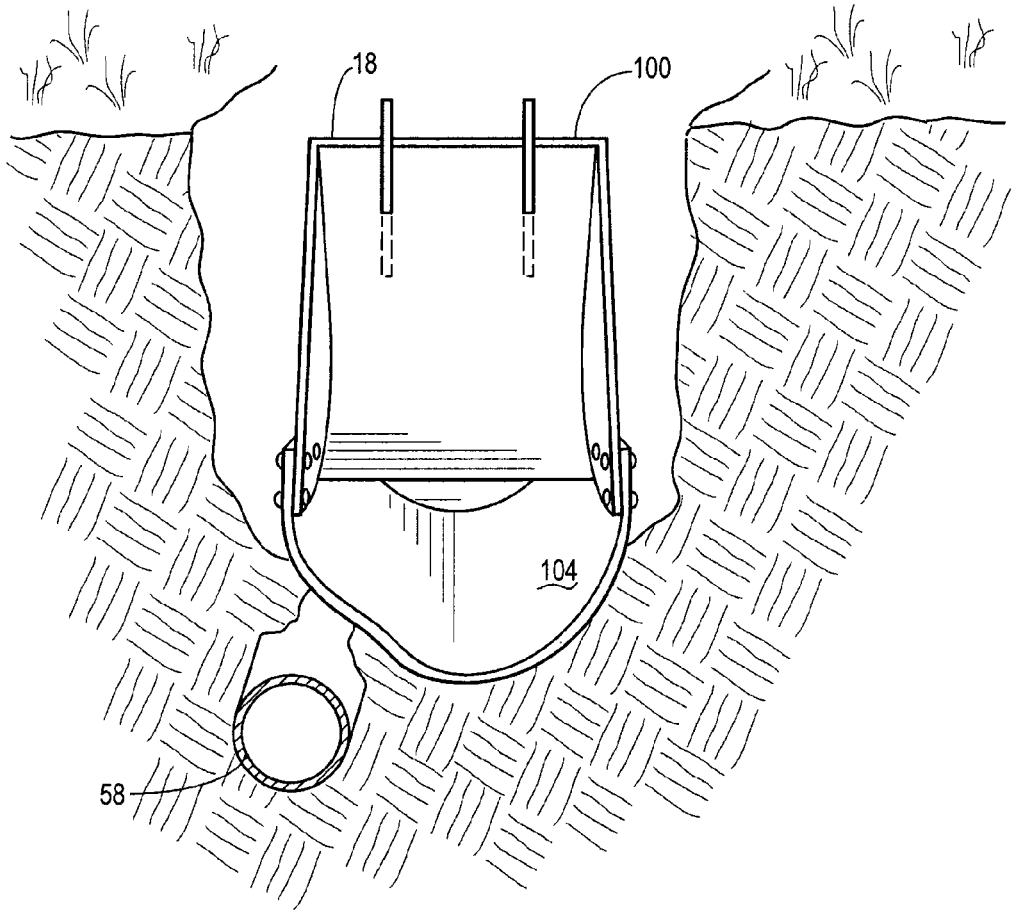
FIG. 3 is a partially cutaway front view of the excavation bucket of FIG. 2 excavating the earth around a buried pipeline.

As best shown in FIG. 3, the resilient member 104 is adapted to deflect when a pressure or force is imparted on it, such as when the bucket 18 impacts, or presses against, a buried pipeline 58. Upon release of the pressure, such as by moving the bucket 18 away from the pipeline 58, the resilient portion 104 returns to a substantially-non-deflected condition, such as is shown in FIG. 2A. In operation, an operator of the backhoe 14 (FIG. 1) causes the bucket 18 to tilt downward such that the digging edge 140 of the resilient member 104 cuts into the earth. As the digging edge 140 penetrates the earth, the bucket 18 is gradually tilted backwards to scoop the earth into the bucket cavity 116 such that it may be removed from the ground to form a trench or hole extending below the surface of the ground. As shown in FIG. 3, and described above, when the resilient member 104 impacts, or presses against, the pipeline 58, the resilient member 104, and especially the arcuate shape of the resilient member 104 deflects vertically and laterally such that the bucket 18 will not puncture or otherwise damage the pipeline 58.

When the resilient portion is formed of a polymeric material similar to that used to form poly pipe, the resilient portion is often capable of deflecting to the point that the bucket 18 will not even damage or scrape off a protective coating of the pipe. The pipeline 58 will often contain a fluid that will generally exert some outward pressure on the sidewall of the pipeline 58. Even when the resilient portion 104 is constructed of the same polymeric material as the pipeline 58, i.e., the pipeline 58 formed from a poly pipe, this outward pressure will generally result in the pipeline 58 having a greater effective rigidity than the resilient portion 104 of the bucket 18 such that the bucket 18 will deflect as shown to prevent damage to the pipeline 58.

Even when a buried pipeline 58 is not under any pressure, such as is generally the case for sewer lines, the closed circular cross-section of the pipeline 58 will generally result in a pipe structure that is effectively more rigid than the resilient portion 104 of the bucket 18, such that the bucket 18 will deflect, as shown, to prevent damage to the pipeline 58. However, as also shown, the arcuate shape of the resilient portion 104 permits the resilient portion 104 to deflect and somewhat contour to the pipeline 58 while still remaining open to scoop dirt and the like into the bucket cavity 116. Additionally, the resilient characteristics of the material permits the resilient portion 104 to return to a substantially non-deflected condition upon release of the pressure such that there is no need to repeatedly replace the resilient portion 104 to permit excavation to continue. Although the arcuate shape described for the resilient portion is preferable, numerous other shapes may be used as well. For example, the resilient portion may formed with a generally triangular, rectangular, fanciful, or any other useful, shape that permits the resilient portion to deflect responsive to pressure or force caused upon impacting a buried pipeline or other object with a greater effective rigidity than the resilient portion 104 and to return to a substantially non-deflected condition upon release of the pressure.

Figure 4:
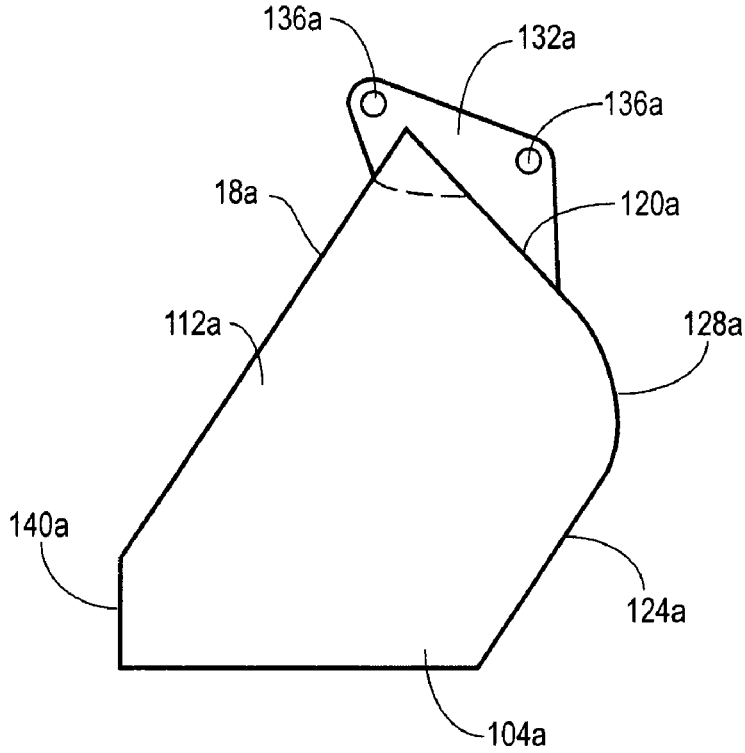
FIG. 4 is a side view of a second embodiment of an excavation bucket constructed in accordance with the present invention.
Figure 4A:
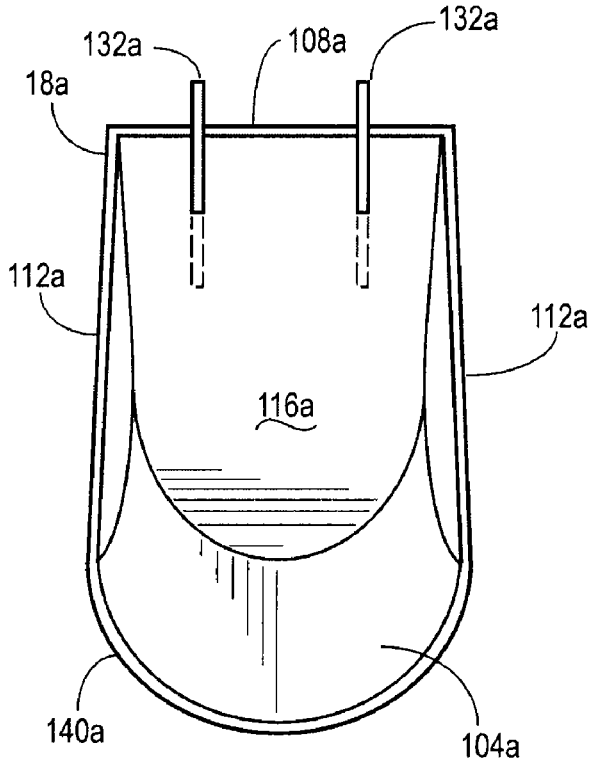
FIG. 4A is a front view of the excavation bucket of FIG. 4.

Referring now to FIGS. 4 and 4A, side and front views, respectively, are shown of a second embodiment of an excavation bucket 18*a* constructed in accordance with the present invention. The bucket 18*a* may be formed of any suitable resilient material and may be molded and/or welded together. The embodiment of the bucket 18*a* depicted in FIGS. 4 and 4A is similar in many respects to the bucket 18 depicted in FIGS. 2 and 2A. However, the bucket 18*a* is preferably formed with a unitary construction in which the entire bucket 18*a* is contiguously formed of a resilient material, such as a polymeric material, having the resilient properties described above with reference to the resilient portion 104 of the bucket 18 of FIGS. 2 and 2A.

Specifically, the bucket 18*a* is provided with a body wall 108*a*, a pair of sidewalls 112*a*, and an arcuate scoop portion 104*a* that cooperate to define an enlarged bucket cavity 116*a*. The sidewalls 112*a* are formed similarly to those described above; however, the lower linear edge portion 124*a* is preferably formed at a greater angle from the upper linear edge portion 120*a* such that the curved portion 128*a* is slightly shorter. Additionally, the body wall 108*a* intersects the arcuate scoop portion 104*a* to enclose the rear portion of an enlarged bucket cavity 116*a*. The bucket 18*a* is also preferably formed with an arcuate front cutting edge 140*a* such that the bucket 18*a* functions in nearly the same manner as the bucket 18 of FIGS. 2 and 2A.

The bucket 18*a* is also preferably provided with one or more connection members 132*a* having a two apertures 136*a*. Due to the resilient properties of the unitary bucket 18*a*, the connection members, as well as other upper portions of the bucket 18*a* may, in some embodiments, be reinforced with more rigid materials such as hardened or tempered steel. For example, the bucket 18*a* could be molded around steel reinforcing members, and/or steel reinforcing members could be contoured to fit the bucket and bolted, screwed, riveted, or otherwise attached to the bucket 18*a* to provide more rigid support to the resilient material of the bucket 18*a*. In other embodiments, the connection members 132*a* (or 132 of FIGS. 2 and 2A) may be joined into a single wider connection member 132*a*, or may be substituted with any other connection member, apparatus, or assembly that permits the bucket 18*a* to be selectively actuated by the operator of a backhoe 14 (FIG. 1) or other piece of machinery.

Figure 5:
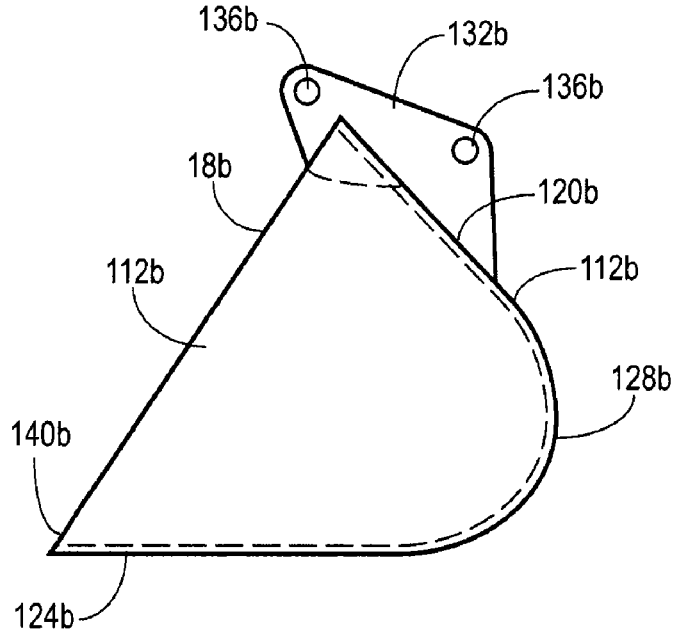
FIG. 5 is a side view of a third embodiment of an excavation bucket constructed in accordance with the present invention.
Figure 5A:
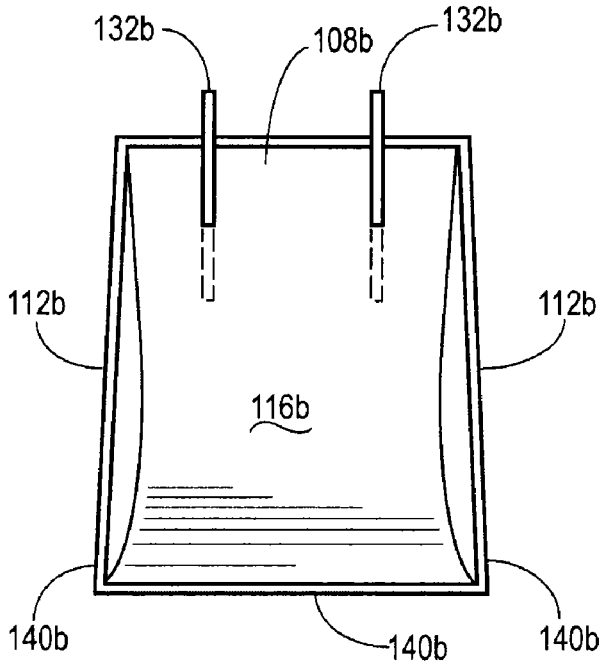
FIG. 5A is a front view of the excavation bucket of FIG. 5.

Referring now to FIGS. 5 and 5A, side and front views, respectively, are shown of a third embodiment of an excavation bucket 18*b* constructed in accordance with the present invention. The bucket 18*b* is similar to the bucket 18*a* of FIGS. 4 and 4A, in that the bucket 18*b* is preferably of unitary construction in which the entire bucket 18*b* is contiguously formed of a resilient material, such as a polymeric material, having the resilient properties described above with reference to the resilient portion 104 of the bucket 18 of FIGS. 2 and 2A. The primary difference between the bucket 18*b* and the bucket 18*a* is that bucket 18*b* is formed with a flattened bottom portion, essentially in a shape similar to that of a standard steel bucket (not shown), rather than with the arcuate scoop portion 104*a* described above and depicted in FIGS. 4 and 4A.

Specifically, the bucket 18*b* is provided with a body wall 108*b* and a pair of sidewalls 112*b* that cooperate to define a bucket cavity 116*b*. The sidewalls 112*b* are formed similar to those of the bucket 18 of FIGS. 2 and 2A, in that they are provided with an upper linear edge portion 120*a*, a lower linear edge portion 124*b*, and an arcuate edge portion 128*b*. However, the material of the body wall 112*b* between the lower linear edge portions 124*b* remains in tact, rather than being removed or omitted. As will be appreciated, when the bucket 18*b* is formed without an arcuate scoop portion, the front edge 140*b* of the body wall 108*b*, as well as the lower portions of the sidewalls 112*b*, acts as the cutting or digging edge as the bucket 18*b* is used to dig or excavate.

As with the bucket 18*a*, the bucket 18*b* is preferably provided with one or more connection members 132*b* having a two apertures 136*b*. Due to the resilient properties of the unitary bucket 18*b*, the connection members 132*b*, as well as other upper portions of the bucket 18*b* may, in some embodiments, be reinforced with more rigid materials such as hardened or tempered steel. For example, the bucket 18*b* could be molded around steel reinforcing members, and/or steel reinforcing members could be contoured to fit the bucket and bolted, screwed, riveted, or otherwise attached to the bucket 18*a* to provide more rigid support to the resilient material of the bucket 18*a*. In other embodiments, the connection members 132*b* may be joined into a single wider connection member 132*b*, or may be substituted with any other connection member, apparatus, or assembly that permits the bucket 18*b* to be selectively actuated by the operator of a backhoe 14 (FIG. 1) or other piece of machinery.

Figure 6:
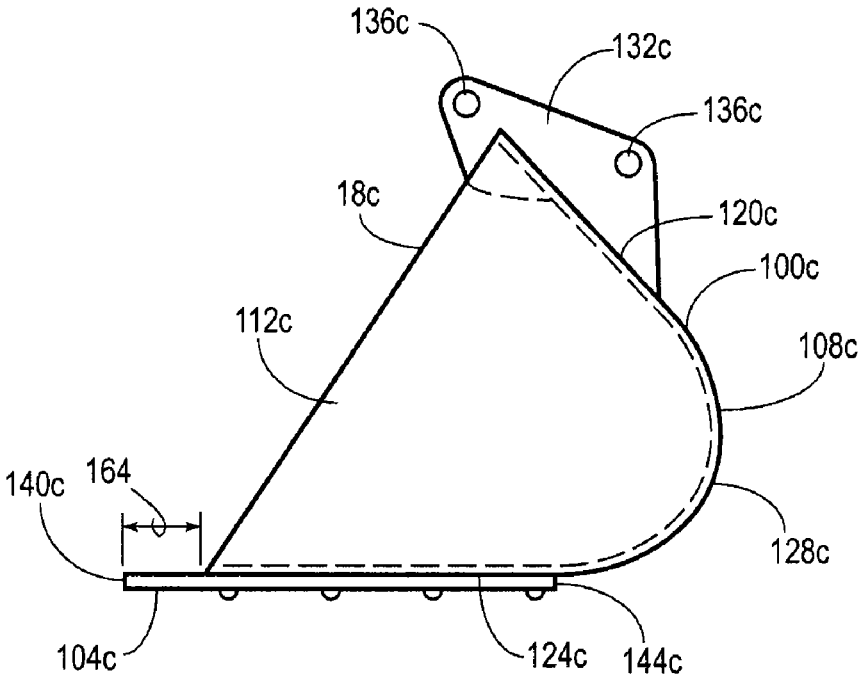
FIG. 6 is a side view of a fourth embodiment of an excavation bucket constructed in accordance with the present invention.
Figure 6A:
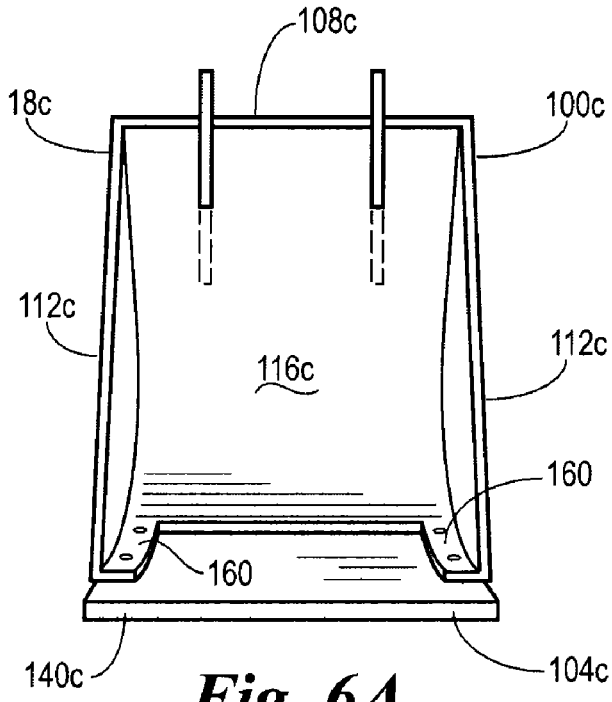
FIG. 6A is a front view of the excavation bucket of FIG. 6.

Referring now to FIGS. 6 and 6A, side and front views, respectively, are shown of a fourth embodiment of an excavation bucket 18*c* constructed in accordance with the present invention. The bucket 18*c* is similar to the bucket 18 of FIGS. 2 and 2A in that it is provided with a rigid portion 100*c* and a resilient portion 104. The primary difference between the two embodiments is that the bucket 18*c* of FIGS. 6 and 6A is formed with a flattened resilient member 104*c* rather then the arcuate resilient member 104 of the bucket 18 of FIGS. 2 and 2A, and the rigid member 100*c* is provided with several features to permit connection of the resilient member 104*c* to the rigid member 100*c*.

In particular, the rigid member 100*c* is formed similarly to the rigid member 100 described above with reference to FIGS. 2 and 2A. The rigid member 100*c* is also similarly provided with a body wall 108*c* and a pair of sidewalls 112*c*. Each sidewall 112*c* is formed with a similar upper linear edge portion 120*c*, lower linear edge portion 124*c*, and arcuate edge portion 128*c*. In contrast, however, the body wall 108*c* is formed so as to leave a pair of flanges 160 extending inward from the lower linear edge portion 124*c* of each sidewall 112*c* to provide an attachment point for the resilient member 104*c*, as shown. In the preferred embodiment, the resilient member 104*c* is preferably attached to the flanges 160 with bolts. However, in other embodiments, the resilient member 104*c* may be attached to the rigid member 100*c* by any suitable means, such as, for example, screws, rivets, interlocking tabs and/or slots, or the like. Similarly, the resilient member 104*c* may be attached to the any suitable portion of the rigid member 100*c*, for example, the resilient member 104*c* may be provided with a pair of flanges (not shown) extending upwards from its lateral edges to be connected to the sidewalls 112*c* of the rigid member 100*c*.

As described above, the rigid member 100*c* is provided with one or more connection members 132*c* that are preferably identical in form and function to the connection members 132 described above and depicted in FIGS. 2 and 2A. The resilient member 104*c* is also formed similarly to the resilient member 104 described above and depicted in FIGS. 2 and 2A. In contrast, however, the resilient member 104*c* is provided with a substantially flat shape. As shown, the cutting or digging edge 140*c* of the resilient member 104*c* extends beyond the front edge of the rigid member by a length 164. The length 164 of the resilient member 104*c* is thus free to deflect responsive to pressure or force caused by impacting, or pressing against, a buried object, such as a pipeline, and return to a substantially non-deflected condition upon release of the pressure or force.

From the above description, it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. An excavation bucket, comprising:

a rigid member having a pair of sidewalls and at least one connection member pivotally connectable to a portion of an articulated arm of a piece of machinery, each of the sidewalls having a forward end, a rearward end, an upper end, and a lower end, the sidewalls being supported in a spaced apart relationship to one another so that the sidewalls cooperate to define a cavity with an open bottom; and a resilient member having a front edge, a rear edge, a first lateral edge, and a second lateral edge, the first lateral edge connected to one of the sidewalls and the second lateral edge connected to the other sidewall such that the resilient member extends across the open bottom of the rigid member with the front edge positioned forward of the forward ends of the sidewalls so as to serve as a digging edge and the rear edge positioned rearward of the open bottom, the resilient member being fabricated of a polymeric material to deflect in response to pressure from impact and to return to a substantially non-deflected condition upon release of the pressure.

2. The excavation bucket of claim 1, wherein the lateral edges of the resilient member are positioned on an exterior side of the sidewalls.

3. The excavation bucket of claim 1, wherein the resilient member is substantially U-shaped.

4. The excavation bucket of claim 1, wherein the rigid member further comprises a body wall extending between the sidewalls, and wherein the at least one connecting member extends from the body wall.

5. The excavation bucket of claim 4, wherein at least a portion of the body wall extends downwardly toward the open bottom.

6. An excavation apparatus, comprising:

a piece of machinery having an articulated arm; and an excavation bucket operatively associated with the articulated arm of the piece of machinery, the excavation bucket comprising:

a rigid member having a pair of sidewalls and at least one connection member pivotally connected to the articulated arm of the piece of machinery, each of the sidewalls having a forward end, a rearward end, an upper end, and a lower end, the sidewalls being supported in a spaced apart relationship to one another so that the sidewalls cooperate to define a cavity with an open bottom; and a resilient member having a front edge, a rear edge, a first lateral edge, and a second lateral edge, the first lateral edge connected to one of the sidewalls and the second lateral edge connected to the other sidewall such that the resilient member extends across the open bottom of the rigid member with the front edge positioned forward of the forward ends of the sidewalls so as to serve as a digging edge and the rear edge positioned rearward of the open bottom, the resilient member being fabricated of a polymeric material to deflect in response to pressure from impact and to return to a substantially non-deflected condition upon release of the pressure.

7. The excavation apparatus of claim 6, wherein the lateral edges of the resilient member are positioned on an exterior side of the sidewalls.

8. The excavation apparatus of claim 6, wherein the resilient member is substantially U-shaped.

9. The excavation apparatus of claim 6, wherein the rigid member further comprises a body wall extending between the sidewalls, and wherein the at least one connecting member extends from the body wall.

10. The excavation apparatus of claim 9, wherein at least a portion of the body wall extends downwardly toward the open bottom.

* * * * *